US008702211B2

(12) United States Patent
Rangaraju

(10) Patent No.: US 8,702,211 B2
(45) Date of Patent: Apr. 22, 2014

(54) TECHNIQUE TO MAINTAIN A POSITIVE PRESSURE AT A SEPTUM DURING DEPRESSURIZATION OF AN INK SUPPLY IN AN INKJET PRINTING DEVICE

(75) Inventor: Sheshadri Rangaraju, Karnataka (IN)

(73) Assignee: Hewlett-Packard Development Company, L.P., Houston, TX (US)

( * ) Notice: Subject to any disclaimer, the term of this patent is extended or adjusted under 35 U.S.C. 154(b) by 216 days.

(21) Appl. No.: 13/234,199

(22) Filed: Sep. 16, 2011

(65) Prior Publication Data

US 2013/0070033 A1 Mar. 21, 2013

(51) Int. Cl.
*B41J 2/175* (2006.01)
*B41J 2/17* (2006.01)

(52) U.S. Cl.
CPC ..... *B41J 2/175* (2013.01); *B41J 2/17513* (2013.01)
USPC ..... 347/85; 347/84

(58) Field of Classification Search
USPC ..... 347/84, 85
See application file for complete search history.

(56) References Cited

U.S. PATENT DOCUMENTS

2011/0292136 A1* 12/2011 Kurebayashi et al. ..... 347/85

* cited by examiner

*Primary Examiner* — Jannelle M Lebron

(57) ABSTRACT

A technique to maintain a positive pressure at a septum during depressurization of an ink supply in an inkjet printing device is disclosed. In one example, the ink supply is depressurized to a first predetermined positive pressure using an air pump. Further, a second predetermined positive pressure is maintained at the septum when the ink supply is at the first predetermined positive pressure. Furthermore, the ink supply is further depressurized to a third predetermined positive pressure.

20 Claims, 3 Drawing Sheets

TECHNIQUE TO MAINTAIN A POSITIVE PRESSURE AT A SEPTUM DURING DEPRESSURIZATION OF AN INK SUPPLY IN AN INKJET PRINTING DEVICE

BACKGROUND

Typically, an ink supply station is responsible for delivering ink through an ink tube to a print head in an inkjet printing device. The ink supply station includes an ink supply which contains the ink. Further, the ink tube is connected to the print head via a septum. Typically, the ink supply station is mounted at a positive Z elevation above the print head, a negative Z elevation below the print head or the same elevation as the print head. Generally, in a pressurization sequence, an air solenoid valve is opened and the ink supply is pressurized to approximately about 6 pound-force per square inch (PSI) using an air pump. Upon the pressure on the ink supply reaching to approximately about 6 PSI, an ink solenoid valve is opened to push the ink out of the ink tube. In the pressurized state, the ink supply is locked inside the ink supply station and cannot be removed.

Typically, a depressurization sequence is opposite of the above described pressurization sequence. In the depressurization sequence, the air pump is temporarily disconnected and the air solenoid valve is closed to reduce the air pressure on the ink supply to approximately about 0.25 PSI. At this point, the ink solenoid valve is closed and the ink supply can be replaced with another ink supply. The opening and closing of solenoid valves, such as the air solenoid valve and ink solenoid valve can be very time consuming. Typically, each of the solenoid valve operations (i.e., opening or closing valve operations) takes about 0.5 sec to complete. Once the air pump is temporarily disconnected, the time taken for the solenoid valve operations may cause the air pressure on the ink supply to drop significantly and the drop in the air pressure can be very difficult to control.

Also, in the case where the ink supply station is mounted at the negative Z elevation below the print head, the air pressure on the ink supply drops exponentially from 6 PSI to 0.25 PSI, which may result in a negative pressure at the septum. The negative pressure at the septum may cause air bubbles to be formed in the ink tube leading to a dry firing of pens in the inkjet printing device or damage in the print head. Further, the air bubbles can cause degradation of print quality.

BRIEF DESCRIPTION OF THE DRAWINGS

Examples of the invention will now be described in detail with reference to the accompanying drawings, in which.

The drawings described herein are for illustration purposes only and are not intended to limit the scope of the present disclosure in any way.

DETAILED DESCRIPTION

A technique to maintain a positive pressure at a septum during depressurization of an ink supply in an inkjet printing device is disclosed. In the following detailed description of the examples of the present subject matter, references are made to the accompanying drawings that form a part hereof, and in which are shown by way of illustration specific examples in which the present subject matter may be practiced. These examples are described in sufficient detail to enable those skilled in the art to practice the present subject matter, and it is to be understood that other examples may be utilized and that changes may be made without departing from the scope of the present subject matter. The following detailed description is, therefore, not to be taken in a limiting sense, and the scope of the present subject matter is defined by the appended claims.

Figure 1:
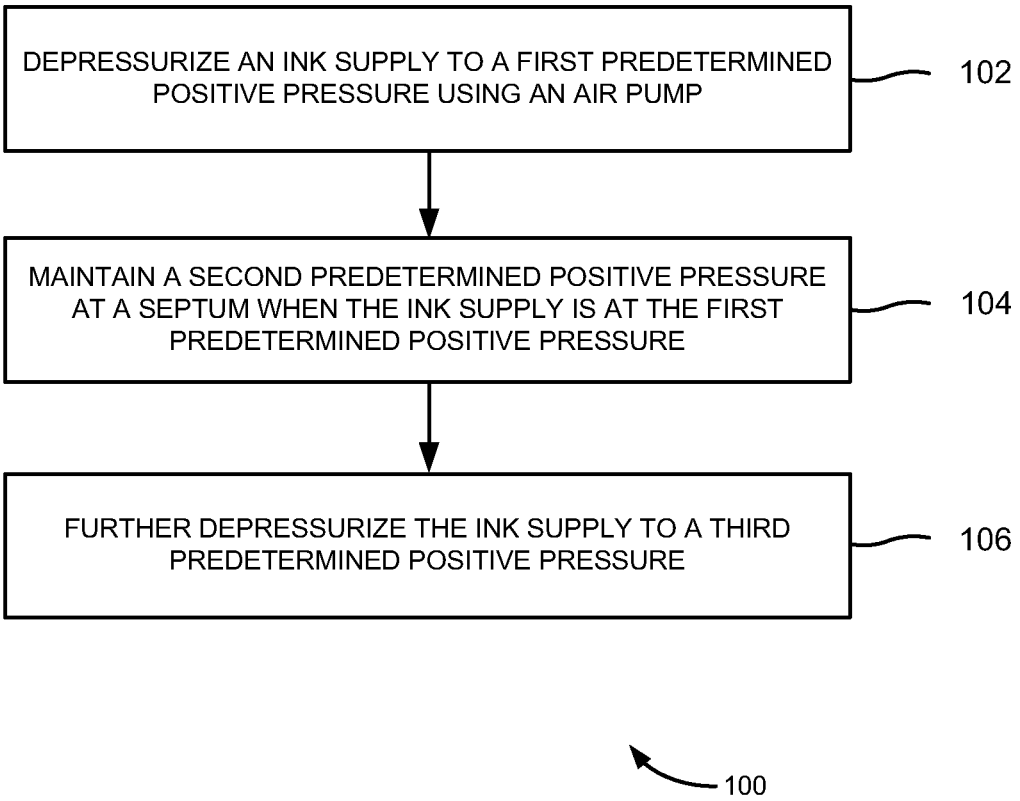
FIG. 1 illustrates an exemplary flow diagram of a method to maintain a positive pressure at a septum during depressurization of an ink supply in an inkjet printing device.

FIG. 1 illustrates an exemplary flow diagram 100 of a method to maintain a positive pressure at a septum during depressurization of an ink supply in an inkjet printing device. At block 102, the ink supply is depressurized to a first predetermined positive pressure using an air pump. The first predetermined positive pressure is approximately ranging from about 1.8 pound-force per square inch (PSI) to about 2.2 PSI. For depressurizing the ink supply to the first predetermined positive pressure, the air pump is operated at the first predetermined positive pressure. Further, the ink supply is depressurized to the first predetermined positive pressure when the air pump is operated at the first predetermined positive pressure. In context, the ink supply is depressurized to the first predetermined positive pressure by pulsing an air solenoid valve when the air pump is operating at the first predetermined positive pressure.

At block 104, a second predetermined positive pressure is maintained at a septum when the ink supply is at the first predetermined positive pressure. The second predetermined positive pressure is approximately about 1 PSI. In one exemplary implementation, the second predetermined positive pressure is maintained at the septum by closing an ink solenoid valve when the ink supply is at the first predetermined positive pressure.

At block 106, the ink supply is further depressurized to a third predetermined positive pressure. The third predetermined positive pressure is approximately about 0.25 PSI. In one exemplary implementation, the ink supply is further depressurized to the third predetermined positive pressure by temporarily disconnecting the air pump and closing the air solenoid valve in the inkjet printing device. For example, the air pump is temporarily disconnected by turning off the air pump.

Figure 2:
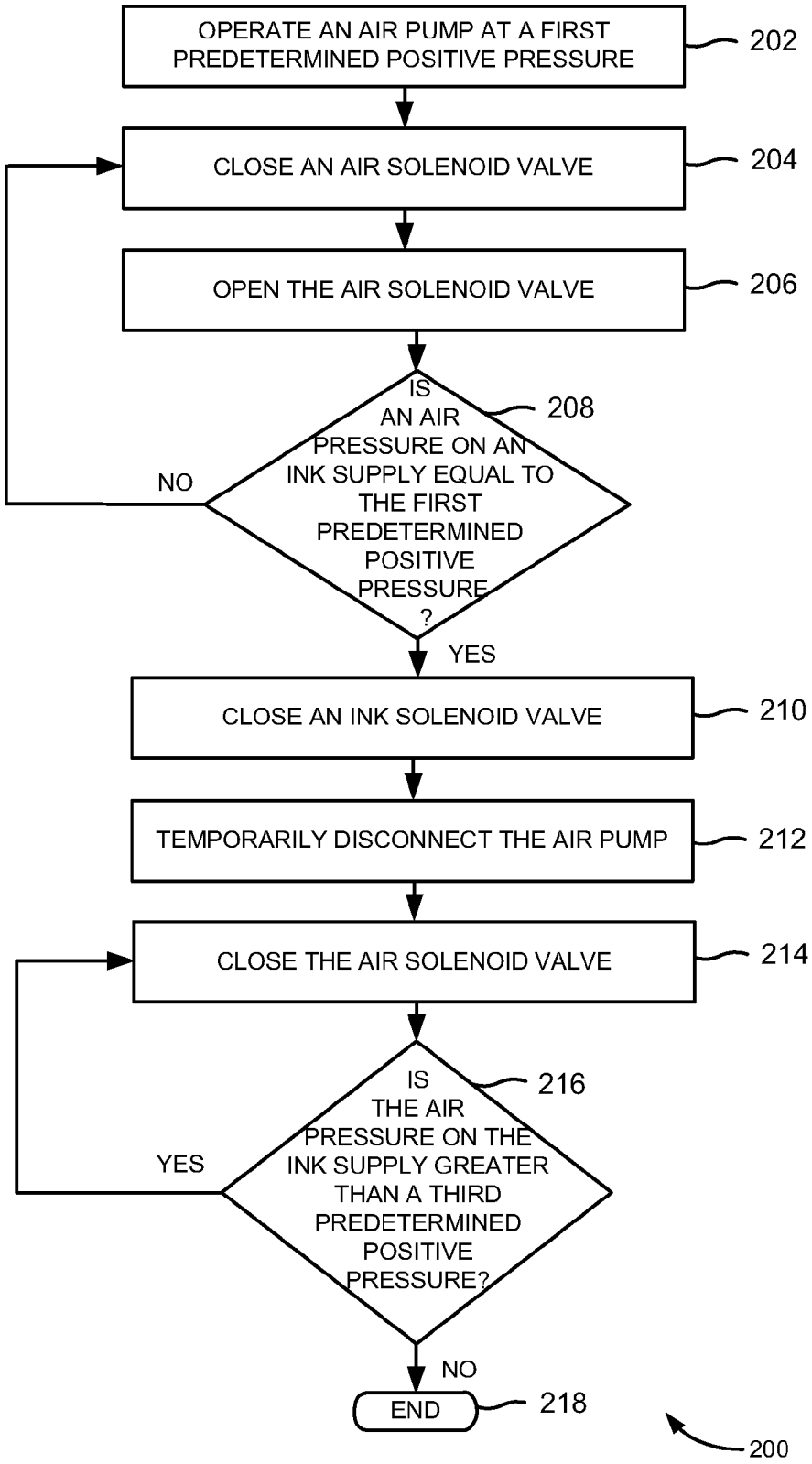
FIG. 2 illustrates another exemplary flow diagram of a method to maintain the positive pressure at the septum during depressurization of the ink supply in the inkjet printing device.

Referring now to FIG. 2, which is another exemplary flow diagram 200 that illustrates a method to depressurize an ink supply in an inkjet printing device. At block 202, an air pump is operated at a first predetermined positive pressure. The first predetermined positive pressure is approximately ranging from about 1.8 PSI to about 2.2 PSI. At block 204, an air solenoid valve in the inkjet printing device is closed. At block 206, the air solenoid valve in the inkjet printing device is opened. At block 208, it is determined whether an air pressure on the ink supply is equal to the first predetermined positive pressure. The steps are repeated from the block 204 if the air pressure on the ink supply is not equal to the first predetermined positive pressure.

At block 210, an ink solenoid valve in the inkjet printing device is closed to maintain a second predetermined positive pressure at a septum if the air pressure on the ink supply is equal to the first predetermined positive pressure. The second predetermined positive pressure is approximately about 1 PSI. At block 212, the air pump is temporarily disconnected. For example, the air pump is temporarily disconnected by turning off the air pump. At block 214, the air solenoid valve in the inkjet printing device is closed. At block 216, it is determined whether the air pressure on the ink supply is greater than a third predetermined positive pressure. The third predetermined positive pressure is approximately about 0.25 PSI. The process steps are repeated from the block 214 if the air pressure on the ink supply is greater than the third predetermined positive pressure. The process is ended at block 218 if the air pressure on the ink supply is not greater than the third predetermined positive pressure.

Figure 3:
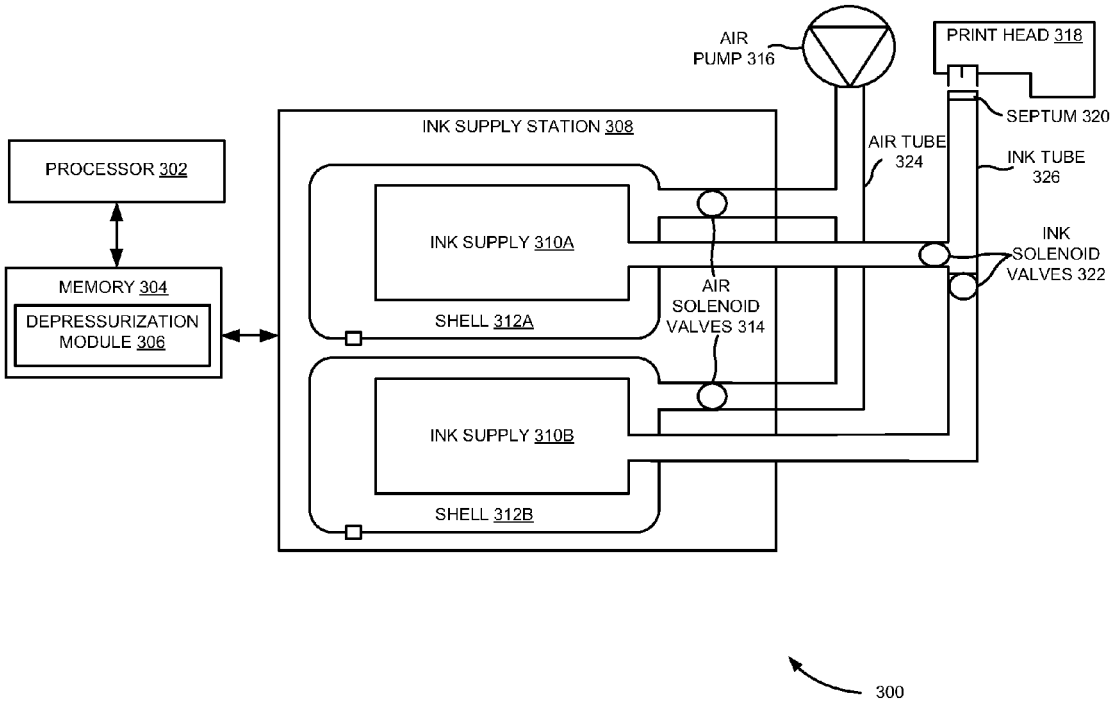
FIG. 3 illustrates an exemplary schematic view of major components of the inkjet printing device used during depressurization of the ink supply.

Referring now to FIG. 3, an exemplary schematic view of major components of an inkjet printing device 300 used during depressurization of an ink supply is illustrated. As shown in FIG. 3, the inkjet printing device 300 includes a processor 302, memory 304, an ink supply station 308, an air pump 316, a septum 320, an air tube 324, an ink tube 326 and a print head 318. Further, the memory 304 includes a depressurization module 306. Furthermore, the ink supply station 308 includes one or more shells 312A and 312B. The shells 312A and 312B further include one or more ink supplies 310A and 310B, respectively. In addition, the air tube 324 and the ink tube 326 include one or more air solenoid valves 314 and one or more ink solenoid valves 322, respectively.

Further as shown in FIG. 3, the memory 304 is coupled to the processor 302. Furthermore, the ink supply station 308 is coupled to the air pump 316 and the print head 318 via the air tube 324 and the ink tube 326, respectively. Particularly, the shells 312A and 312B in the ink supply station 308 are coupled to the air pump 316 via the air tube 324. In addition, the ink supplies 310A and 310B are coupled to the print head 318 via the septum 320. The septum 320 is an interconnecting device adjacent to the ink tube 326, as shown in FIG. 3.

In one exemplary implementation, one of the ink supplies 310A and 310B is active and the other ink supply is a backup. The active ink supply, say the ink supply 310A, supplies ink to the print head 318. The backup ink supply, say the ink supply 310B, starts supplying the ink to the print head 318 when the active ink supply 310A is empty.

In operation, during pressurization, the air pump 316 is operated at an air pressure of approximately about 6 PSI. Further, one of the air solenoid valves 314 associated with the active ink supply 310A is opened to allow air to flow inside the associated shell 312A. Once the air pressure on the active ink supply 310A reaches approximately about 6 PSI, the active ink supply 310A is compressed and one of the ink solenoid valves 322 associated with the active ink supply 310A is opened to push the ink through the ink tube 326.

Further in operation, during depressurization, the depressurization module 306 operates the air pump 316 at a first predetermined positive pressure. The first predetermined positive pressure is approximately ranging from about 1.8 PSI to about 2.2 PSI. Further, the depressurization module 306 pulses the one of the air solenoid valves 314 associated with the active ink supply 310A till the air pressure on the active ink supply 310A reaches the first predetermined positive pressure. For example, pulsing the one of the air solenoid valves 314 includes a sequence of open and close operations of the one of the air solenoid valves 314. Furthermore, the depressurization module 306 closes the one of the ink solenoid valves 322 associated with the active ink supply 310A at the first predetermined positive pressure. At this point, the ink pressure at the septum 320 is maintained at a second predetermined positive pressure. The second predetermined positive pressure is approximately about 1 PSI. In one example, the second predetermined positive pressure is lesser than the first predetermined positive pressure.

In addition, the depressurization module 306 temporarily disconnects the air pump 316. For example, the air pump 316 is temporarily disconnected by turning off the air pump 316. Also, the depressurization module 306 closes the one of the air solenoid valves 314 associated with the active ink supply 310A until the air pressure on the active ink supply 310A reaches a third predetermined positive pressure. The third predetermined positive pressure on the active ink supply 310A is approximately about 0.25 PSI. In one example, the third predetermined positive pressure is lesser than the second predetermined positive pressure. As a result of the above method of depressurization, a positive pressure is maintained at the septum 320.

In various examples, system and method described in FIGS. 1 through 3 propose the technique to maintain the positive pressure at the septum during depressurization of the ink supply in the inkjet printing device. The technique uses the depressurization module to maintain the positive pressure at the septum during depressurization. Thus, formation of air bubbles in an ink tube in the inkjet printing device is prevented. Further, time taken to depressurize an active ink supply is reduced to about 20 to 22 seconds.

Although certain methods, apparatus, and articles of manufacture have been described herein, the scope of coverage of this patent is not limited thereto. To the contrary, this patent covers all methods, apparatus, and articles of manufacture fairly falling within the scope of the appended claims either literally or under the doctrine of equivalents.

What is claimed is:

1. A method to maintain a positive pressure at a septum during depressurization of an ink supply in an inkjet printing device, comprising:

depressurizing the ink supply to a first predetermined positive pressure using an air pump;

maintaining a second predetermined positive pressure at the septum when the ink supply is at the first predetermined positive pressure, wherein the ink supply is coupled to a print head via the septum; and further depressurizing the ink supply to a third predetermined positive pressure.

2. The method of claim 1, wherein the second predetermined positive pressure is maintained at the septum by closing an ink solenoid valve when the ink supply is at the first predetermined positive pressure.

3. The method of claim 1, wherein the ink supply is further depressurized to the third predetermined positive pressure by temporarily disconnecting the air pump and closing an air solenoid valve in the inkjet printing device.

4. The method of claim 1, wherein the first predetermined positive pressure is approximately ranging from about 1.8 pound-force per square inch (PSI) to about 2.2 PSI, wherein the second predetermined positive pressure is approximately about 1 PSI, and wherein the third predetermined positive pressure is approximately about 0.25 PSI.

5. The method of claim 1, wherein depressurizing the ink supply to the first predetermined positive pressure using the air pump comprises:

operating the air pump at the first predetermined positive pressure; and depressurizing the ink supply to the first predetermined positive pressure when the air pump is operated at the first predetermined positive pressure.

6. The method of claim 5, wherein the ink supply is depressurized to the first predetermined positive pressure by pulsing an air solenoid valve when the air pump is operated at the first predetermined positive pressure.

7. An inkjet printing device, comprising:

a processor;

memory coupled to the processor, wherein the memory includes a depressurization module;

an ink supply station coupled to the memory, wherein the ink supply station includes one or more ink supplies;

an air pump coupled to the ink supply station;

a septum; and a print head coupled to the one or more ink supplies via the septum, wherein the depressurization module depressurizes one of the one or more ink supplies to a first predetermined positive pressure using the air pump, wherein the depressurization module maintains a second predetermined positive pressure at the septum when the one of the one or more ink supplies is at the first predetermined positive pressure, and wherein the depressurization module further depressurize the one of the one or more ink supplies to a third predetermined positive pressure.

8. The inkjet printing device of claim 7, wherein the first predetermined positive pressure is approximately ranging from about 1.8 pound-force per square inch (PSI) to about 2.2 PSI, wherein the second predetermined positive pressure is approximately about 1 PSI, and wherein the third predetermined positive pressure is approximately about 0.25 PSI.

9. The inkjet printing device of claim 7, wherein the septum is an interconnecting device adjacent to an ink tube comprising one or more ink solenoid valves in the inkjet printing device.

10. The inkjet printing device of claim 9, wherein the depressurization module maintains the second predetermined positive pressure at the septum by closing one of the one or more ink solenoid valves associated with the one of the one or more ink supplies when the one of the one or more ink supplies is at the first predetermined positive pressure.

11. The inkjet printing device of claim 7, wherein the depressurization module operates the air pump at the first predetermined positive pressure, and wherein the depressurization module depressurizes the one of the one or more ink supplies to the first predetermined positive pressure when the air pump is operated at the first predetermined positive pressure.

12. The inkjet printing device of claim 11, wherein the air pump is coupled to the ink supply station using an air tube comprising one or more air solenoid valves.

13. The inkjet printing device of claim 12, wherein the depressurization module depressurizes the one of the one or more ink supplies to the first predetermined positive pressure by pulsing one of the one or more air solenoid valves associated with the one of the one or more ink supplies when the air pump is operated at the first predetermined positive pressure.

14. The inkjet printing device of claim 13, wherein the depressurization module further depressurizes the one of the one or more ink supplies to the third predetermined positive pressure by temporarily disconnecting the air pump and closing one of the one or more air solenoid valves associated with the one of the one or more ink supplies in the inkjet printing device.

15. A non-transitory computer-readable storage medium to maintain a positive pressure at a septum during depressurization of an ink supply in an inkjet printing device, having instructions that, when executed by a computing device cause the computing device to:

depressurize the ink supply to a first predetermined positive pressure using an air pump;

maintain a second predetermined positive pressure at the septum when the ink supply is at the first predetermined positive pressure, wherein the ink supply is coupled to a print head via the septum; and further depressurize the ink supply to a third predetermined positive pressure.

16. The non-transitory computer-readable storage medium of claim 15, wherein the second predetermined positive pressure is maintained at the septum by closing an ink solenoid valve when the ink supply is at the first predetermined positive pressure.

17. The non-transitory computer-readable storage medium of claim 15, wherein the ink supply is further depressurized to the third predetermined positive pressure by temporarily disconnecting the air pump and closing an air solenoid valve in the inkjet printing device.

18. The non-transitory computer-readable storage medium of claim 15, wherein the first predetermined positive pressure is approximately ranging from about 1.8 pound-force per square inch (PSI) to about 2.2 PSI, wherein the second predetermined positive pressure is approximately about 1 PSI, and wherein the third predetermined positive pressure is approximately about 0.25 PSI.

19. The non-transitory computer-readable storage medium of claim 15, wherein depressurizing the ink supply to the first predetermined positive pressure using the air pump comprises:

operating the air pump at the first predetermined positive pressure; and depressurizing the ink supply to the first predetermined positive pressure when the air pump is operated at the first predetermined positive pressure.

20. The non-transitory computer-readable storage medium of claim 19, wherein the ink supply is depressurized to the first predetermined positive pressure by pulsing an air solenoid valve when the air pump is operated at the first predetermined positive pressure.

* * * * *